US006161741A

United States Patent [19]

French

[11] Patent Number: 6,161,741

[45] Date of Patent: Dec. 19, 2000

[54] HOLSTER SECUREMENT SYSTEM

[75] Inventor: John M. French, Boise, Id.

[73] Assignee: Michaels of Oregon Co., Oregon City, Oreg.

[21] Appl. No.: 09/351,462

[22] Filed: Jul. 12, 1999

[51] Int. Cl.[7] ..... F41C 33/02

[52] U.S. Cl. ..... 224/198; 224/192; 224/272; 224/912; 248/311.2

[58] Field of Search ..... 224/183, 197, 224/198, 260, 414, 192, 269, 272, 912; 248/206.2, 311.2

[56] References Cited

U.S. PATENT DOCUMENTS

| | | | |
|---|---|---|---|
| 2,410,640 | 11/1946 | Engle . | |
| 2,641,395 | 6/1953 | Engle . | |
| 3,894,667 | 7/1975 | Baldocchi . | |
| 3,952,930 | 4/1976 | Baldocchi . | |
| 4,273,276 | 6/1981 | Perkins . | |
| 4,419,794 | 12/1983 | Horton, Jr. et al. | 224/197 X |
| 4,424,924 | 1/1984 | Perkins . | |
| 4,483,501 | 11/1984 | Eddy . | |
| 4,591,081 | 5/1986 | Bianchi et al. . | |
| 4,718,586 | 1/1988 | Hagino | 224/197 X |
| 4,721,276 | 1/1988 | Moss | 248/311.2 X |
| 4,750,656 | 6/1988 | Bianchi et al. . | |
| 4,874,118 | 10/1989 | Parlante . | |
| 5,018,653 | 5/1991 | Shoemaker . | |
| 5,054,170 | 10/1991 | Otrusina | 224/197 X |
| 5,100,036 | 3/1992 | Rogers et al. . | |
| 5,167,355 | 12/1992 | Hill . | |
| 5,176,347 | 1/1993 | Rouail | 248/206.2 |
| 5,193,725 | 3/1993 | Radocy | 224/197 X |
| 5,213,240 | 5/1993 | Dietz et al. | 224/183 |
| 5,265,781 | 11/1993 | Nichols . | |
| 5,275,317 | 1/1994 | Rogers et al. . | |
| 5,421,497 | 6/1995 | Gilmore . | |
| 5,522,527 | 6/1996 | Tsai | 224/414 |
| 5,551,610 | 9/1996 | Clifton, Jr. . | |
| 5,551,611 | 9/1996 | Gilmore . | |
| 5,564,610 | 10/1996 | Barron | 224/268 |
| 5,598,958 | 2/1997 | Ryan, III et al. . | |
| 5,622,297 | 4/1997 | Rogers et al. . | |
| 5,632,426 | 5/1997 | Beletsky et al. . | |
| 5,730,342 | 3/1998 | Tien | 224/197 X |
| 5,810,221 | 9/1998 | Beletsky et al. . | |
| 5,839,630 | 11/1998 | Dunstan et al. . | |
| 5,850,996 | 12/1998 | Liang | 224/197 X |
| 6,006,969 | 12/1999 | Kim | 224/197 X |

*Primary Examiner*—Stephen K. Cronin
*Attorney, Agent, or Firm*—Chernoff, Vilhauer, McClung & Stenzel, LLP

[57] ABSTRACT

A holster securement system for securing a holster to a belt comprises a body having at one end a loop for receiving the belt. The securement system also has a holster mount capable of being rigidly connected to the holster. An engagement member selectively detachably interconnects the body and the holster mount. The engagement member rigidly connects the holster mount to the body when engaged, and the engagement member enables the body and the holster mount to be selectively movable with respect to each other when disengaged.

15 Claims, 8 Drawing Sheets

HOLSTER SECUREMENT SYSTEM

BACKGROUND OF THE INVENTION

The present invention relates to a holster securement system used to secure a gun holster to a belt, and more particularly to a holster securement system that allows adjustable positioning of the gun holster relative to the belt, and that allows detachment of a holster from a belt.

Modern holsters offer a wide variety of features to protect a handgun within the holster and to secure the gun against unauthorized use. An example of such a holster is disclosed in Marx, U.S. Pat. No. 5,419,474. Such holsters typically have a hard shell or skeleton made from a tough abrasion resistant polymer. Because the holster and/or the handgun must be manipulated to release the handgun from the holster, it is desirable to rigidly secure the holster to the belt of the user so that the handgun may be quickly released from the holster. One prior art method for rigidly securing the holster to a belt involves the use of a belt loop that fits over the belt on one end and is bolted to the holster at the other end of the belt loop. The belt loop holder used to secure the PRO-3® holster sold by the assignee is an example of this type of securing device.

While modern holsters offer greater protection to the handgun and the handgun user, the holsters themselves can be uncomfortable to wear, particularly by law enforcement personnel who must carry handguns while working. For example, in many patrol cars, especially ones with bucket seats, the holster is pushed upward by the seat and causes great discomfort. The rigid connection between the holster and belt loop aggravates this discomfort.

Handgun users also often have individual preferences for the orientation and ride height of the holster relative to the belt. For example, some holsters have locking mechanisms for securing the handgun that require the handgun to be withdrawn at a certain angle relative to the holster, and accordingly it may be desirable to secure the holster to the belt at an offset angle. In addition, handgun users may prefer the holster to be higher or lower relative to the belt, or may prefer various angular orientations of the holster relative to the belt, depending on the holster and handgun make and individual preferences. In addition, individual users may prefer different angular orientations between the surface of the belt loop and the holster, so that the holster may be offset from the user's body at different angles.

Hill, U.S. Pat. No. 5,167,355 discloses a holster connected to a belt loop that allows adjustment of the angular orientation of the holster relative to the belt loop. Adjustment is accomplished in that holster by securing two ratchets 76 and 78 together with a screw 106. However, Hill does not allow selective detachment of the holster from the belt loop, because to adjust the angular orientation of the holster relative to the belt loop, the screw must be loosened to allow the two ratchets to rotate with respect to each other.

In addition, there may be times when a handgun user wishes to remove the handgun from the belt, for example when riding in a car. However, removing the handgun from its holster vitiates the protection afforded by the holster, particularly where the holster secures the handgun within the holster to prevent unauthorized use of the handgun. Thus, to keep the handgun in the holster, the handgun user must remove the belt loop from the belt by partially removing the belt and sliding the belt loop off of the belt. This can be difficult or nearly impossible with modern law enforcement duty belts, which may have additional items secured to the duty belt. When the holster is removed from the belt, there is a further need to again secure the holster. For example, if a holster is removed in a car, it is desirable to secure the holster so that the holster does not move around within the interior of the car while the car is in motion.

What is therefore desired is a holster securement system that increases the comfort of wearing a holster that may be securely and rigidly attached to a belt, that allows adjustment of the angular and/or vertical orientation of the holster relative to the belt, that may also allow a holster to be selectively removed from a belt, that may further provide for a secure storage place for the holster, and that is easily and cost effectively manufactured.

SUMMARY OF THE INVENTION

The present invention overcomes the drawbacks of the prior art by providing in one aspect a holster securement system for securing a holster to a belt, comprising means for securing the body to the belt. The securement system also has a holster mount capable of being rigidly connected to the holster. An engagement member selectively detachably interconnects the body and the holster mount. The engagement member rigidly connects the holster mount to the body when engaged, and the engagement member enables the body and the holster mount to be selectively movable with respect to each other when disengaged.

In another separate aspect of the invention, a holster securement system for securing a holster to a belt comprises a body defining at one end an opening for receiving the belt. The system also includes a fastening mechanism adapted to be rigidly connected to the holster and operatively engageable with the body. The fastening mechanism includes a release member movable between a first position and a second position. The fastening mechanism selectively detachably interconnects the body with the holster, the fastening mechanism rigidly connecting the holster to the body when the release member is in the first position, and the fastening mechanism enabling the body and the holster to be selectively movable with respect to each other when the release member is moved to the second position.

The various aspects of the present invention have one or more of the following advantages. By providing a securement system that allows a holster to be selectively detached, the holster may be easily and quickly removed from a belt when desired. Thus, for example, the holster may be removed when a user is riding in a car, or when the user wishes to leave the holster in a locker. The system may also allow for multiple adjustment of the position of the holster relative to the belt loop body. In those embodiments in which the securement system allows rotational adjustment of the holster, the securement system allows the holster to be secured to the belt loop body at several different angular orientations. Thus, for example, a user could rotate the holster to a more comfortable position when seated. In embodiments that allow vertical adjustment, the system allows variation in the ride height of the holster relative to the belt loop depending on the preference of the user. In addition, by providing a body that allows variation in the ride height of the holster, the manufacturer need only stock a single unit rather than multiple units to allow for different ride heights of the holster.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
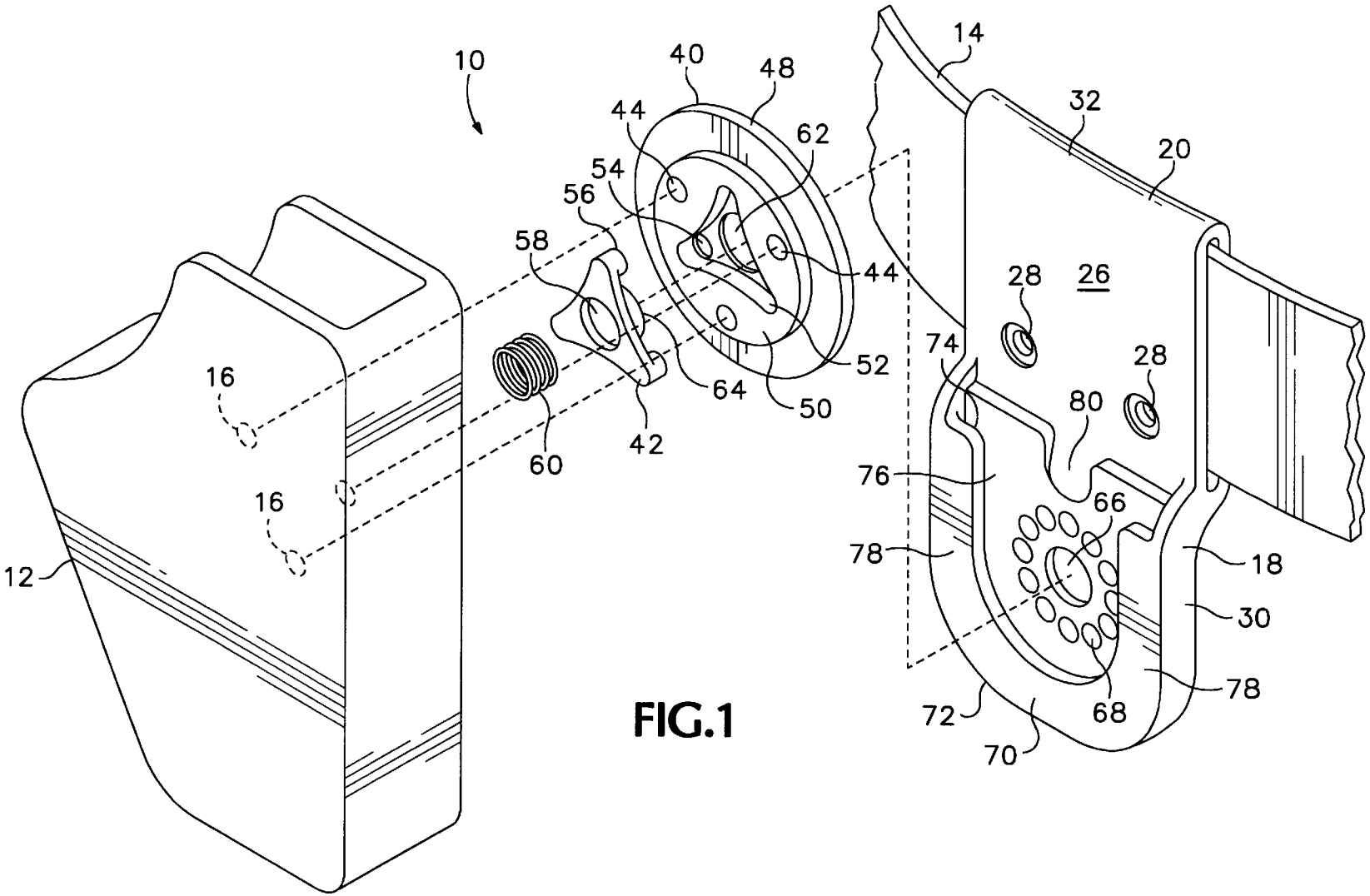
FIG. 1 shows an exploded perspective view of an exemplary embodiment of a holster securement system of the present invention.

Referring now to the drawings, wherein like numerals refer to like elements, the present invention provides in one aspect shown in FIG. 1 a holster securement system 10 for securing a holster 12 containing a handgun 13 to a belt 14. The holster 12 may be any type of holster, but is preferably a holster having a plurality of spaced apart bores 16 for receiving fasteners such as bolts (not shown). An example of a holster suitable for use with the present invention includes the holster disclosed in Marx, U.S. Pat. No. 5,419,474, which is herein incorporated by reference. Where the holster securement system 10 of the present invention provides rotational adjustment of the holster 10 relative to the belt loop body 18, it is preferred that the holster 12 have some type of retaining mechanism to secure the handgun within the holster 12, such as a retaining mechanism disclosed in Marx, U.S. Pat. No. 5,419,474 or Rogers et al. U.S. Pat. No. 5,100,036. Alternatively, the retaining mechanism could be a strap. The belt 14 may be any belt suitable for carrying a holster 12, such as a standard law enforcement duty belt. While the holster 12 is depicted as holding a handgun 13, the holster 12 may be used with any suitable firearm.

Figure 2:
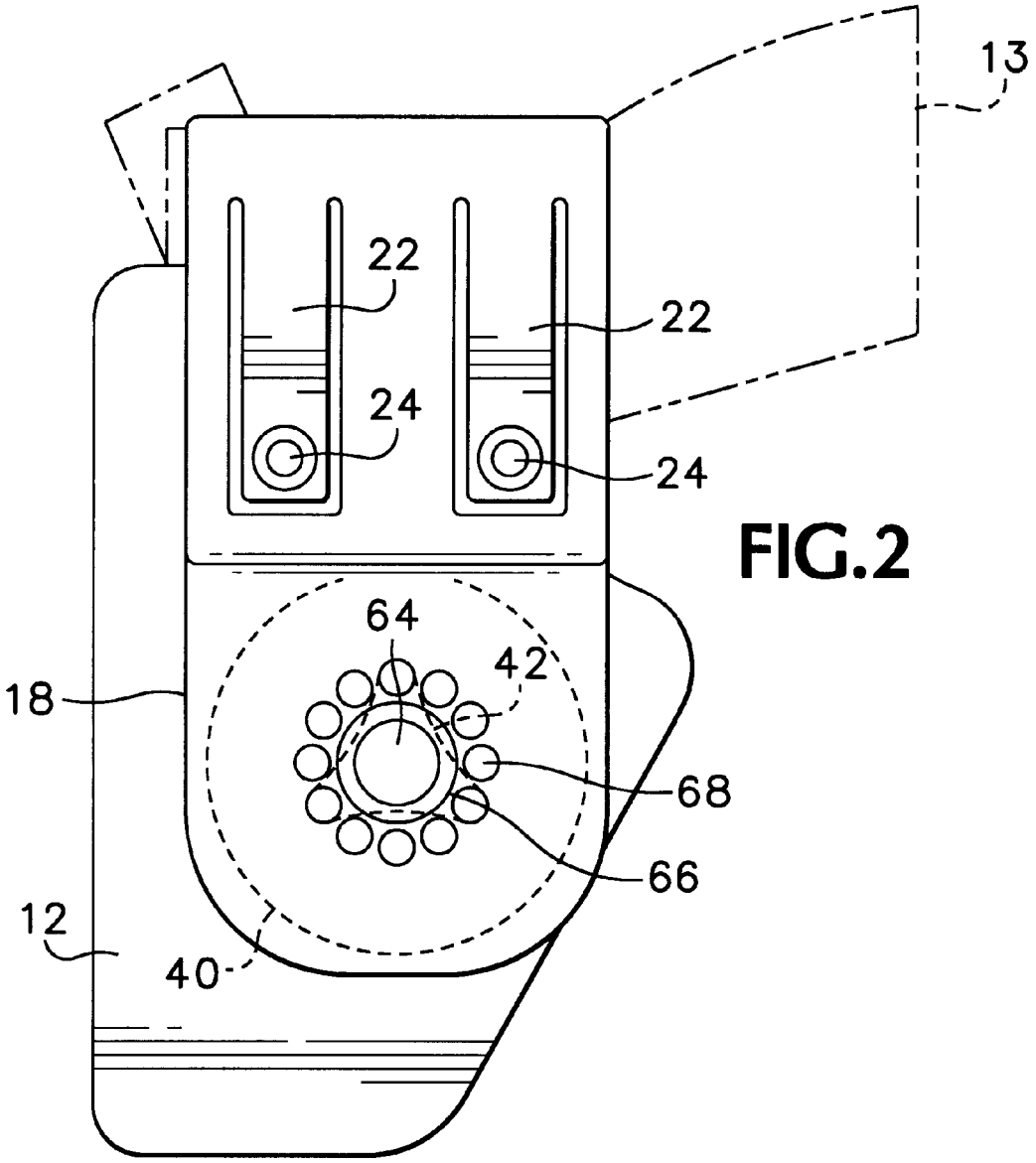
FIG. 2 shows a rear view of the holster securement system of FIG. 1, showing the holster mount and engaging member in phantom view.

The securement system 10 has a belt loop body 18 that has at one end a loop 20 for receiving the belt 14. Referring to FIG. 2, the rear of the loop 20 includes two elongated securement members 22, each of these securement members 22 being attached to the body 18 at the upper portion of the loop 20. Each securement member 22 defines a bore 24 located at a position on the securement member 22 so that the bore 24 is located beneath the belt 14. The wall 26 on the opposite side of the loop 20 from the securement members 22 also defines two bores 28, each bore 28 being defined opposite to one of the bores 24 in the securement members 22. (See FIG. 1). A bolt or other fastening member (not shown) passes through a respective bore 28 in the wall 26 and a respective bore 24 in a securement member 22. The body 8 is secured to the belt 14 by tightening the fasteners so that the belt 14 is securely held in place between the securement members 22 and the wall 26. Alternatively, other fastening or clamping mechanisms may be used to securely fasten the belt loop body 18 to the belt 14. For example, the belt loop body could be secured by a clamp or rivets to the belt. As yet another alternative, the belt loop body 18 could define a pair of openings for receiving the belt 14 as shown for example in Shoemaker, U.S. Pat. No. 5,018,653.

In one embodiment of the present invention, the lower portion 30 of the body 18 is slightly offset from the upper portion 32 of the body 18. This improves the comfort of wearing the holster 12 by providing a gap between the hip or leg of the user and the lower portion 30 of the body 18. Nevertheless, the body 18 may or may not provide such an offset, depending on the preference of the user.

Figure 3B:
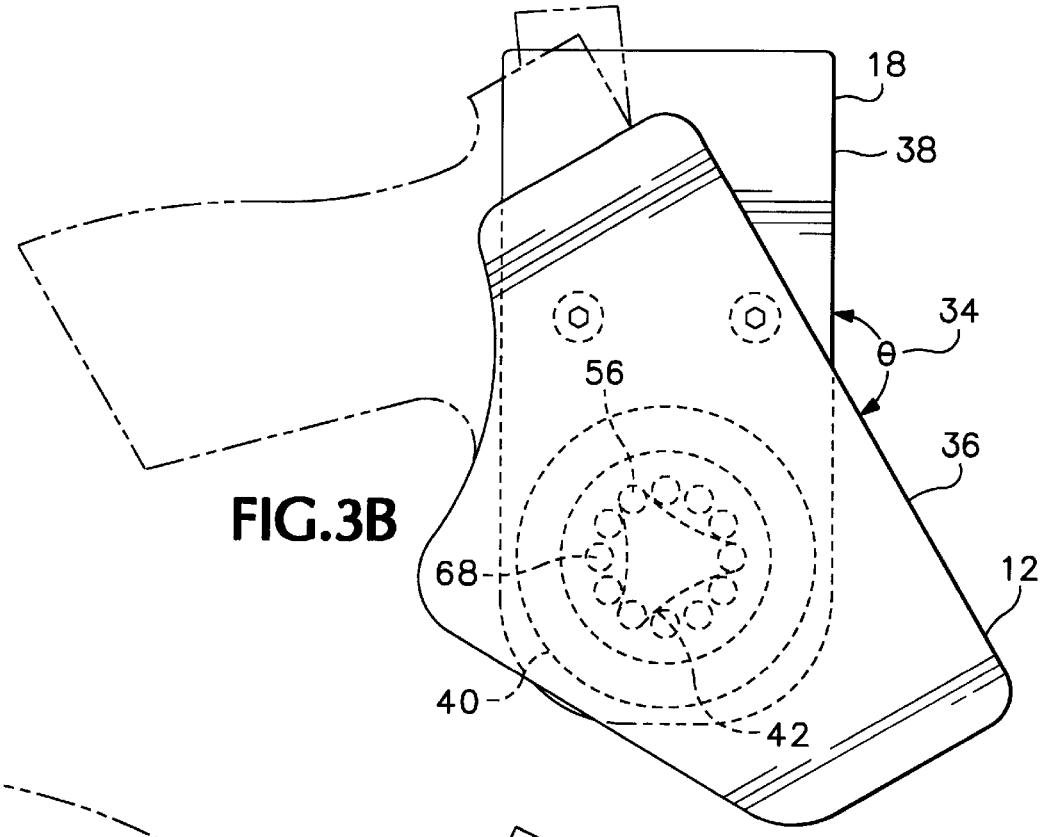
FIG. 3B shows another front view of the holster securement system of FIG. 1, but with the holster rotated to a different angular orientation than in FIG. 3A.
Figure 3A:
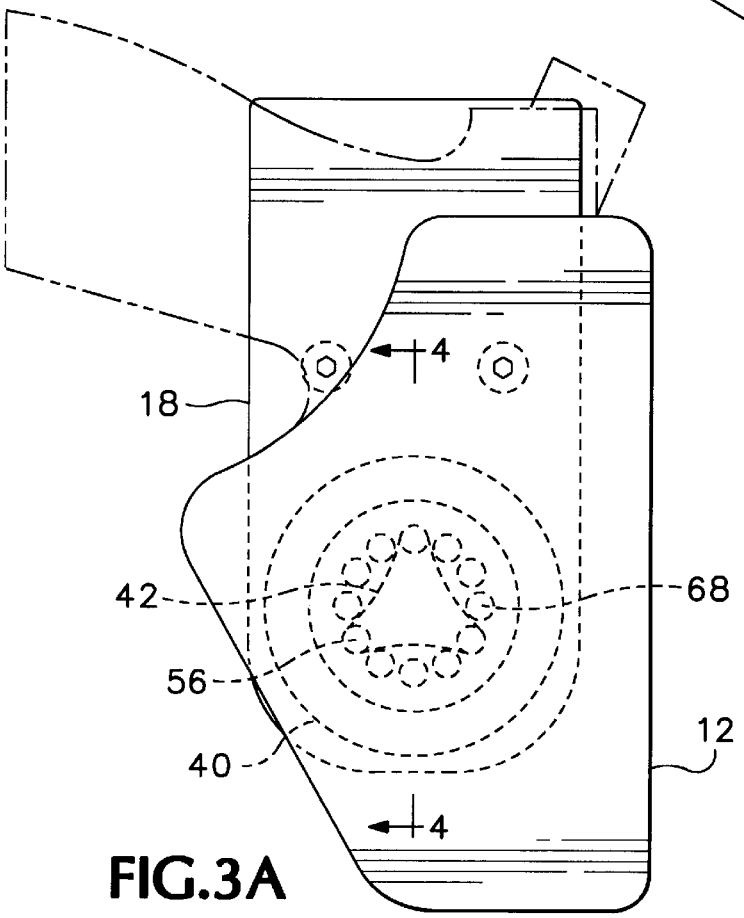
FIG. 3A shows a front view of the holster securement system of FIG. 1, showing the holster mount and engaging member in phantom view.

In one aspect of the present invention, the holster securement system 10 includes a fastening system to allow the holster 12 to be selectively detachably connected to the body 18. Preferably, the holster 12 may be selectively detachably connected to the body 18 at at least two different locations and preferably at an even greater number of locations. The different locations may be vertically displaced from each other on the body 18, so as to allow a user to adjust the ride height of the holster 12 relative to the body 18. Alternatively, the different locations may be angularly displaced from each other, so as to allow a user to rotate the holster to adjust the angular orientation of the holster 12 relative to the body 18. The angular orientation of the holster 12 relative to the body 18 may be defined by defining an angle 34 between the spine 36 of the holster 12 and a side 38 of the body 18. For example, FIGS. 3A and 3B show two different angular orientations of a holster 12 relative to a body 18.

In one embodiment of the present invention, the fastening system includes a holster mount 40 and engagement member 42. The holster mount 40 defines three bores 44 to allow the holster mount 40 to be rigidly connected to the holster 12 by three fasteners, such as bolts 17 (shown in FIG. 4), which are received by the three bores 16 in the holster 12. Alternatively, the holster mount 40 could be rigidly connected using another mechanical fastening mechanism or by adhering the holster mount 40 to the holster 12. In one embodiment, the holster mount 40 is disk shaped, having an outer rim portion 48 and a central hub 50. The central hub 50 defines a triangularly shaped cavity 52 for receiving the engaging member 42. The holster mount 40 further defines in each corner of the cavity 52 a bore 54 through the holster mount 40. The engaging member 42 is triangularly shaped to fit within the cavity 52 and has at each corner a pin 56 that passes through a corresponding bore 54 in the holster mount 40. The engaging member 42 also defines a cavity 58 which houses a coil spring 60. When the holster mount 40 is secured to the holster 12, one side of the spring 60 presses against the holster 12 and the other side of the spring 60 presses against the engaging member 42. The holster mount 40 also defines a central bore 62 for receiving a release button 64 on the engaging member 42. When the holster mount 40 is attached to the holster 12, the spring 60 urges the engaging member 42 toward the holster mount 40 so as to cause the release button 64 and the pins 56 to be pushed through the respective corresponding bores 62 and 54 of the holster mount 40.

To secure the holster 12 relative to the body 18, the lower portion 30 of the body 18 defines a central bore 66 for receiving the release button 64 of the engaging member 42.

The body 18 also defines a plurality of smaller bores 68 located circumferentially about the central bore 66 for receiving respective ones of the pins 56 of the engaging member 42. The lower portion 30 of the body 18 also defines a shelf 70 located around the outer periphery 72 of the lower portion 30 of the body 18. The shelf 70 defines a groove between the inner surface 74 of the shelf 70 and the outer surface 76 of the lower portion 30 of the body 18 where the shelf 70 directly opposes the lower portion 30 of the body 18. The shelf 70 and holster mount 40 are sized so that the outer rim 48 of the holster mount 40 fits within the groove defined by the shelf 70 and the body 18, and the central hub 50 fits between the two side portions 78 of the shelf 70. Accordingly, the outer rim 48 is capable of sliding into the groove and the holster mount 40 is restrained from moving away from the body 18 by the shelf 70.

Figure 4A:
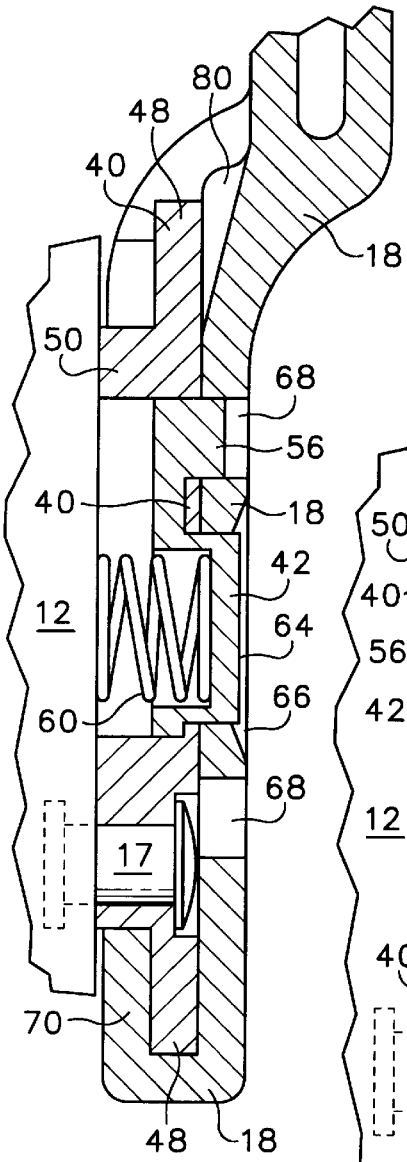
FIG. 4A shows a cross section view taken along the line 4—4 of FIG. 3A.

To engage the holster mount 40 with the body 18, the user slides the outer rim 48 of the holster mount 40 into the groove between the shelf 70 and the lower portion 30 of the body 18. Preferably, in embodiments in which the lower portion 30 of the body is offset from the upper portion 32, the lower portion 30 defines a ramped slot 80 to accommodate the release button 64. The release button 64 is fully extended because of the spring 60 when the release button 64 enters the slot 80. The ramped slope of the slot 80 pushes the release button 64 inward toward the holster 12 as the holster mount 40 slides downward. The downward motion of the holster mount 40 is eventually stopped when the central hub 50 reaches the bottom of the shelf 70. At this location, the release button 64 is opposite to the central bore 66 in the body 18. The holster mount 40 is then rotated (if necessary) so that the pins 56 in the engaging member 42 pass through corresponding bores 68 in the body 18. The spring 60 pushes the engaging member 42 toward the body 18 so that the pins 56 engage corresponding bores 68 in the body 18 and the release button 64 is urged into the central bore 66 in the body 18. With the three pins 56 of the engaging member pushed into three of the bores 68 of the body 18 by the spring 60, the holster 12 is securely rigidly connected to the body 18, as is illustrated in FIG. 4A.

Figure 4B:
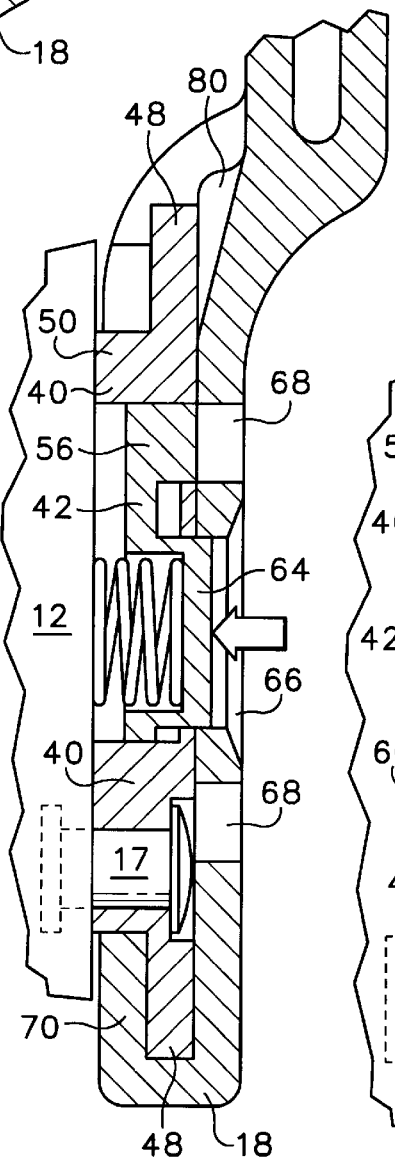
FIG. 4B shows the same cross section as FIG. 4A, but showing the release button of the engaging member being depressed.

As will be appreciated, the fastening system just described allows the holster 12 to be selectively connected to the body 18 at a number of different angular orientations. To rotate the holster 12, the button 64 is depressed (as shown in FIG. 4B), which disengages the pins 56 from the bores 68 in the body 18. This allows the holster 12 to be rotated relative to the body 18. When the holster 12 is rotated to a new position, the button 64 may be released so that the pins 56 may engage a new set of bores 68, thus securing the holster 12 in a new angular orientation relative to the body 18 and the belt 14. Depending on the number of bores 68 provided relative to the number of pins 56 on the engaging member 42, the holster 12 may be oriented at a plurality of angular orientations relative to the body 18.

Figure 4C:
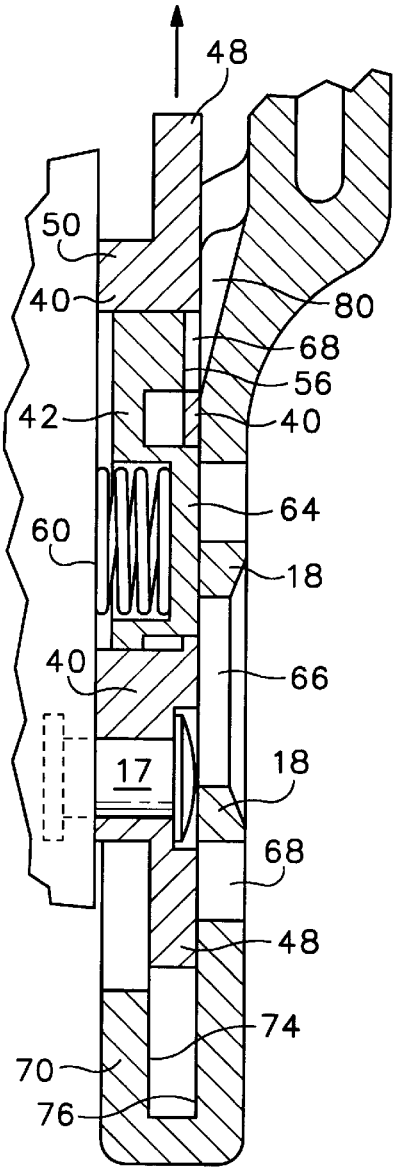
FIG. 4C shows the same cross section as FIG. 4A, but with the holster being moved vertically relative to the belt loop body.

To remove the holster 12 from the body 18, the release button 64 is further depressed so as to disengage the pins 56 from the bores 68 and to disengage the release button 64 from the bore 66. The holster mount 40 may then slide upward relative to the body 18 as shown in FIG. 4C, so that the shelf 70 no longer restrains the holster mount 40 and the holster mount 40 may be disengaged from the body 18.

Figure 8:
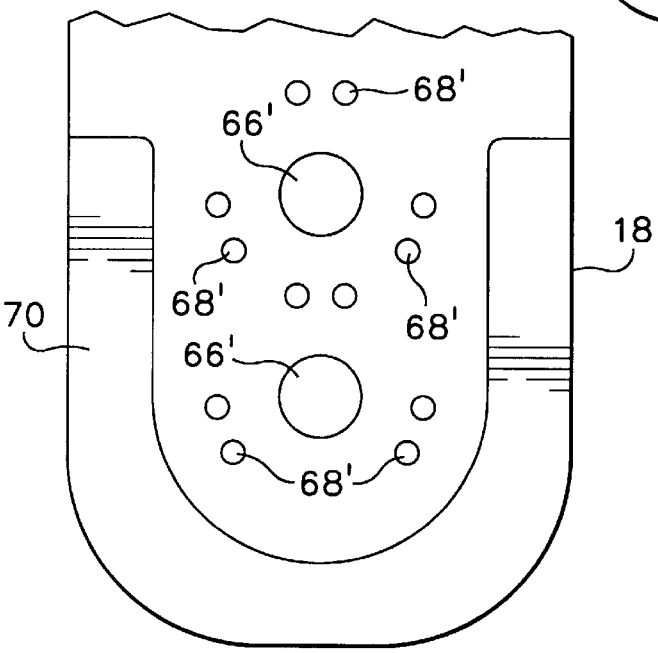
FIG. 8 shows an alternative arrangement of bores for the system of FIG. 1.

While FIG. 1 shows a particular set of bores 68 which allows angular orientation of the holster 12 relative to the body 18, yet another set of bores 66 and 68 may be provided which allows adjustment of the vertical height of the holster 12 relative to the body 18. FIG. 8 shows such an alternative set of bores 66' and 68' for the body 18 which allows both variation in angular orientation of the holster 12 relative to the body 18, as well as variation in the vertical displacement of the holster 12 relative to the body 18. Similarly, other bore configurations are possible which allow different variations in angular orientation and vertical displacement of the holster 12 relative to the body 18.

Alternatively, other fastening systems could be used which allow selective detachment of the holster 12 relative to the body 18 which also rigidly connect the holster 12 at various angular orientations and/or vertical displacements relative to the body 18. For example, it is within the scope of the invention to change the shapes of the various components, such as the shape of the engaging member 42. The mechanism used to selectively detach the holster 12 from the body 18 could also be separated from the mechanism used to adjust the angular position of the holster. For example, instead of using the pins 56 on the engaging member 42, a ratcheting mechanism could be used in which the holster mount 40 has a series of teeth which engage a pawl biased by a living hinge located on the sidewall of the body 18 between the shelf 70 and the body 18. The engagement of the teeth by the pawl would rigidly connect the holster mount 40 to the body 18, while releasing the pawl would allow free rotation of the holster mount 40. Since the release button 64 would remain engaged with bore 66, the holster 12 could be freely rotated without detaching the holster 12 from the body 18.

While the embodiment of FIG. 1 shows the holster mount 40 and engaging member 42 as separate pieces, it is within the scope of the invention to provide a holster 12 having a fastening system integrally formed with the holster 12 itself. For example, the holster 12 itself could have a fastening mechanism integrally formed with the holster 12 that selectively allowed attachment or detachment of the holster 12 to the body 18, and that allowed the holster 12 to be rigidly connected to the body 18 at a plurality of locations.

Figure 5:
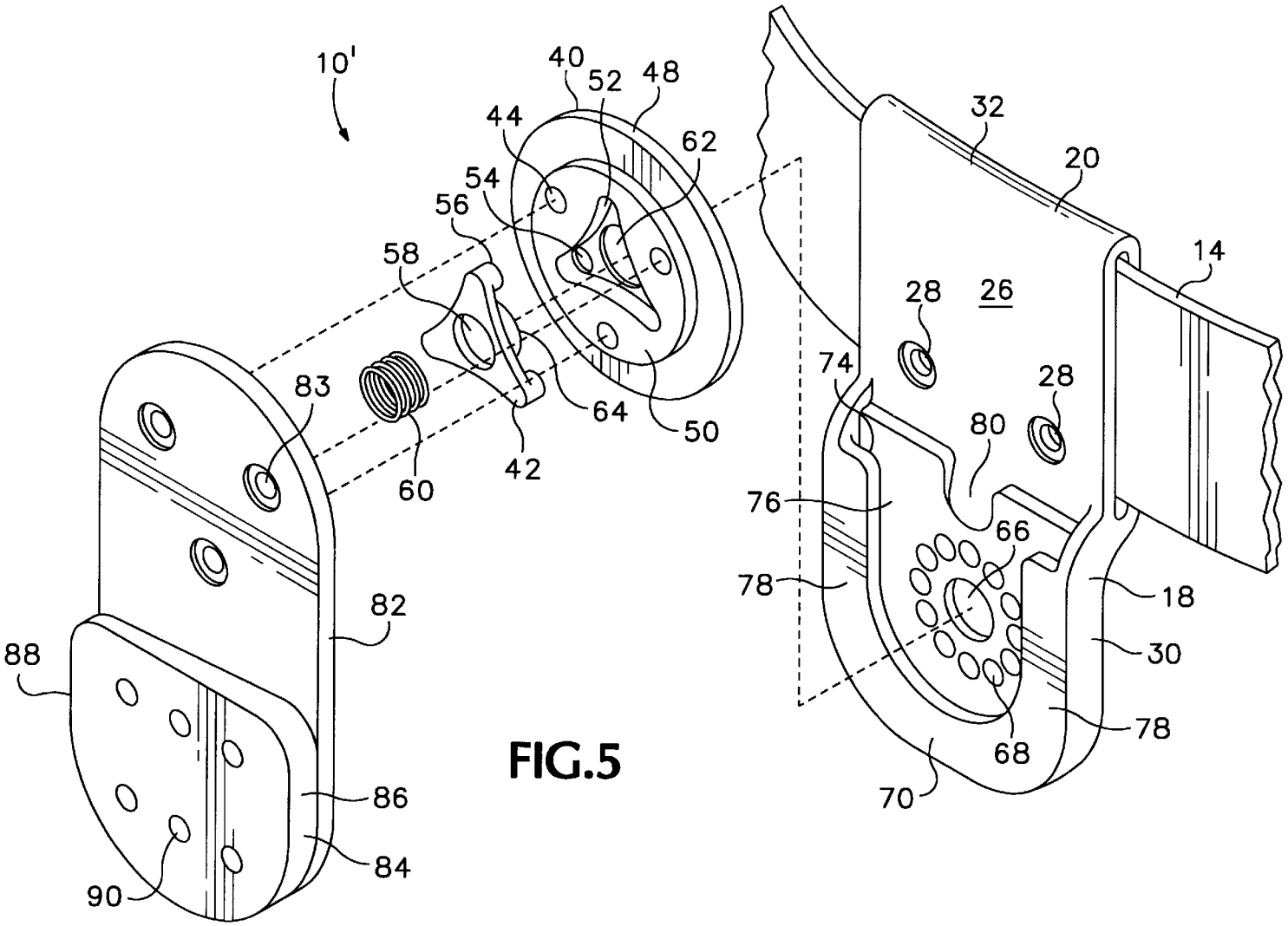
FIG. 5 shows an exploded view of another exemplary embodiment of a holster securement system of the present invention.

Referring now to FIG. 5, in yet another embodiment the securement system 10' includes an extension member 82. In this embodiment, the holster mount 40 is attached to the extension member 82 at one end of the extension member 82 using fasteners, such as bolts (not shown) which are inserted through bores 83 in the extension member 82 and the bores 44 of the holster mount 40. Alternatively, the extension member 82 could be attached to the holster mount in any other conventional fashion, either mechanically, or by adhesion, or by forming the extension member 82 and holster mount 40 as a single integral piece. The other end of the extension member is connected to the holster 12, such as with fasteners such as bolts which pass through another set of bores in the extension member 82. The length of the extension member 82 may be chosen to provide the desired vertical displacement of the holster 12 relative to the body 18. In addition, when used with the embodiment depicted in FIG. 5, for example, the holster mount 40 may be rotated so that the extension member either points upward to carry the holster 12 in an elevated position, or the holster mount 40 may be rotated so that the extension member points downward (as illustrated in FIG. 5), to carry the holster 12 in a lowered position relative to the lower portion 30 of the body 18.

Referring again to FIG. 5, in yet another separate aspect of the invention, the system 10' further includes a spacer 84. The spacer 84 allows for further distancing of the holster 12 away from the leg or hip of the user of the holster 12. The spacer 84 provides a set of bores 90 to allow the bolts attaching the extension member 82 with the holster 12 to pass through the spacer 84. In addition, the spacer 84 may also allow for yet another angular adjustment of the holster 12 relative to the body 18 if desired. The spacer 84 may be formed so that it is wedge shaped, being thicker at one end 86 relative to another end 88. For example, as shown in FIG. 5, the spacer 84 may be shaped so that the holster 12 is angled slightly relative to the outer surface 76 of the body 18. The dimensions of the spacer 84 may be chosen to provide the user of the holster 12 with a desired spacing and with a desired angular offset between the holster 12 and the outer surface 76 of the body 18. This embodiment thus provides another significant advantage, by providing for yet another angular adjustment of the position of the holster 12 relative to the body 18.

Figure 6:
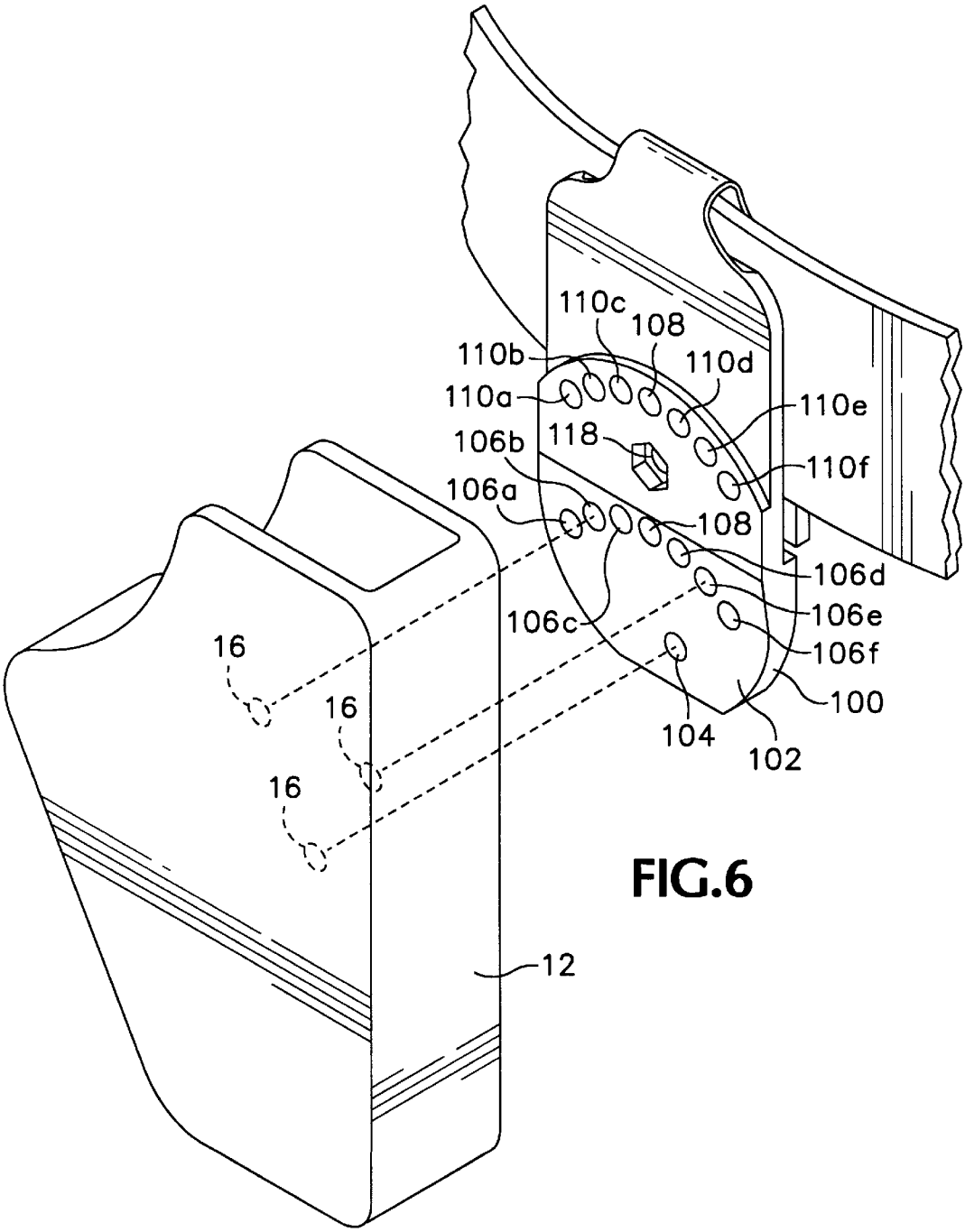
FIG. 6 shows yet another embodiment of a holster securement system of the present invention.
Figure 7:
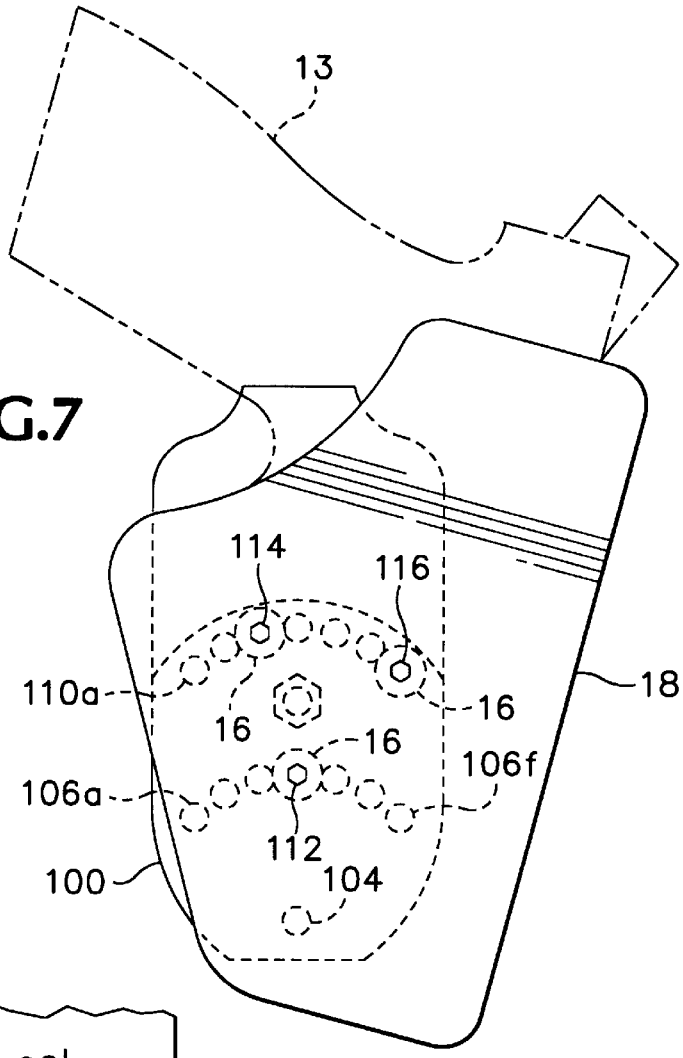
FIG. 7 show the securement system of FIG. 6 but with the holster secured at an offset angular orientation relative to the belt loop body.

Referring now to FIG. 6, in yet another separate aspect of the invention a body 100 is provided having a plurality of bores that allows attachment of the holster 12 to the body 100 at a plurality of locations. In one embodiment, the body 100 defines in a lower portion 102 a first bore 104 and a first set of bores 106*a–f* arranged in arcuate fashion relative to the first bore 104. The body 100 also defines a second bore 108 vertically displaced from the first bore 104 and a second set of bores 110*a–f* arranged in arcuate fashion above the second bore 108. The holster 12 has a set of three bores 16. The holster 12 is attached to the body 100 by means of three bolts or other fastening members (not shown). The holster 12 may be attached at a first location on body 100 by securing a bolt through bore 104 and two other bolts through two bores chosen from the first set of bores, such as bores 106*b* and 106*e*. Alternatively, different pairs of bores from the first set of bores 106*a–f* could be chosen, such as the pair 106*a*, 106*d* or the pair 106*c*, 106*f*. Thus, depending on which pair of bores 106*a–f* is chosen, the holster 12 may be secured to the body 100 at three different angular orientations. In addition, the holster 12 may be attached to the body 18 at a different height by using the second bore 108 and two bores chosen from the second set 110*a–f*, thus adjusting the vertical height of the holster 12 relative to the body 100. Again, the second set of bores 110*a–f* allows for three angular orientations of the holster 12 relative to the body 100, depending on which pair of bores is selected. FIG. 7 illustrates attachment of the holster 12 to the body 100 at an upper location using the bore 108 and the pair of bores 110*c*, 110*f*. (Fasteners 112, 114, and 116 pass through these respective bores.) While one configuration of bores has been shown, other configurations are possible to allow other variations in angular orientation or vertical adjustment of the holster 12 relative to the body 100.

As shown in FIG. 6, the body 100 is secured to the belt 14 using a single fastener passing through bore 118 in the front portion of the loop. The loop may either be flexible, allowing the rear portion of the loop to bend relative to the front portion, or the loop may be rigid. When the loop is rigid, the rear portion of the loop may have cutouts (not shown) to allow access to the second set of bores 110*a–f*.

Figure 9:
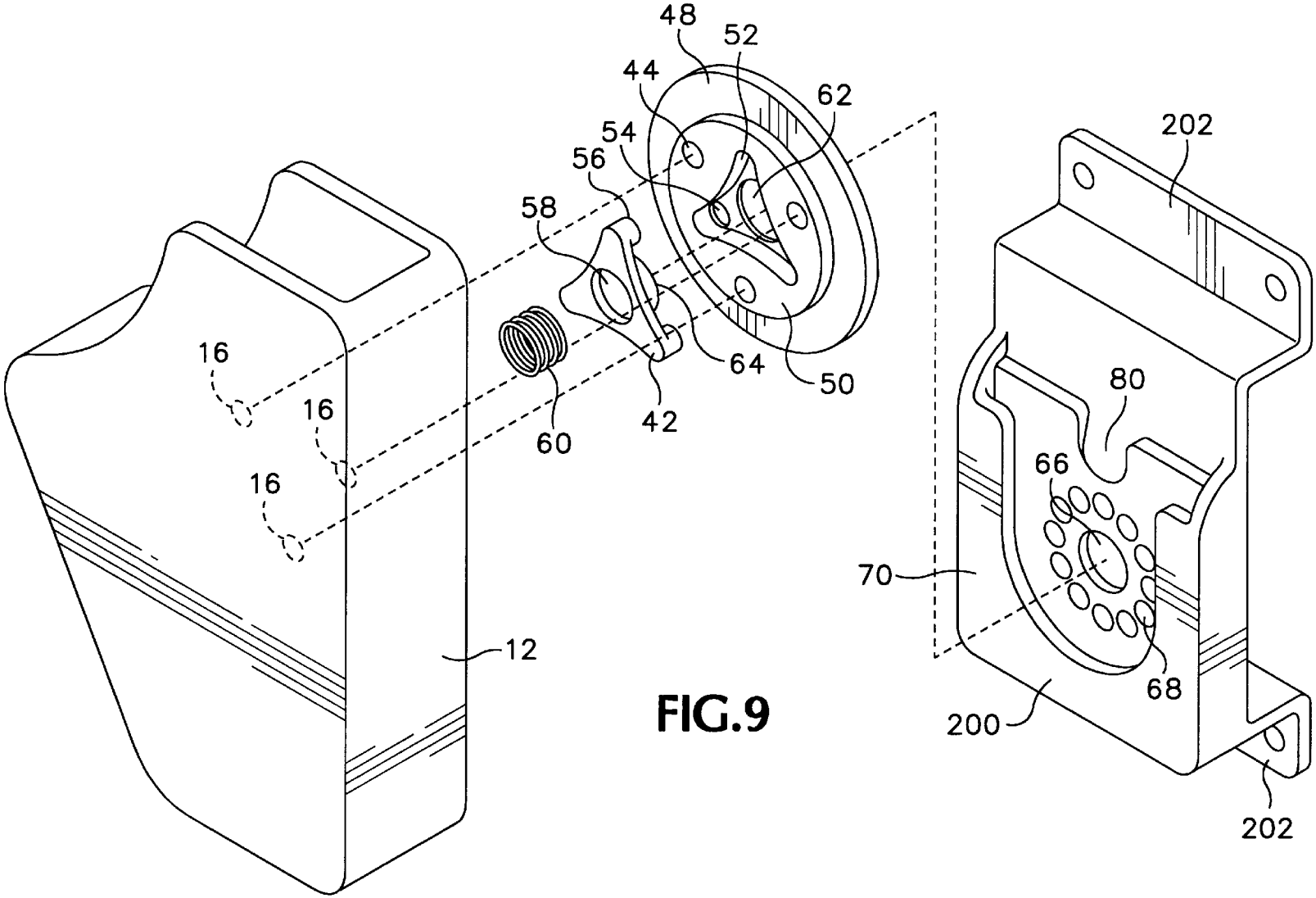
FIG. 9 shows yet another embodiment of a wall mounted body.

Referring now to FIG. 9, in yet another separate aspect of the invention, the holster securement system 10 provides an additional body 200 that may be mounted to a surface such as a wall, the interior of a gun locker, or a surface in a car. The additional body 200 may be identical to the body 18 shown in FIGS. 1–2, or alternatively the loop may be omitted and mounting brackets 202 may be provided as shown in FIG. 9. The additional body 200 provides another location at which the holster 12 may be secured when the holster 12 is detached from the user's belt loop body 18. By providing an additional body 200 attached to a surface such as a wall (as illustrated in FIG. 9), the holster securement system provides a secure location for storing the holster 12. For example, an additional body 200 may be mounted in a gun cabinet, in a locker, on a wall, inside of a car, or any other location where a user may desire to store a holster 12, with or without a handgun stored in the holster 12.

The various embodiments of the present invention may be manufactured using conventional methods and materials. The various parts such as the body, engaging member, and holster mount, may be made from any rigid material, such as metal or plastic. Preferably, these parts are injection molded from a polymeric material, such as glass filled nylon, SuperTough™ nylon, or other equivalent polymeric material.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A holster securement system for securing a holster to a belt, comprising:

(a) a body having at one end means for securing said body to the belt;

(b) a holster mount adapted to be rigidly connected to the holster;

(c) an engagement member selectively detachably interconnecting said body and said holster mount, said engagement member rigidly connecting said holster mount to said body when engaged, and said engagement member enabling said body and said holster mount to be selectively movable with respect to each other when disengaged; and (d) a biasing mechanism urging said engagement member into engagement with said body and said holster mount.

2. The holster securement system of claim 1 wherein said engagement member is capable of selectively interconnecting said holster mount with said body at a first position and a second position while said body remains fixed to said belt.

3. The holster securement system of claim 2 wherein said first position is vertically displaced from said second position.

4. The holster securement system of claim 2 wherein said first position is angularly displaced relative to said second position.

5. The holster securement system of claim 1 wherein said body has a shelf defining a groove for receiving a portion of said holster mount and said holster mount is rotatable with respect to said body when said engagement member is disengaged and said portion of said holster mount is received within said groove.

6. The holster securement system of claim 1 wherein said body has a shelf defining a groove for receiving a portion of said holster mount and said holster mount is movable vertically with respect to said body when said engagement member is disengaged and said portion of said holster mount is received within said groove.

7. The holster securement system of claim 6 wherein said holster mount is rotatable with respect to said body when said engagement member is disengaged.

8. The holster securement system of claim 1 further comprising a second body capable of being mounted on a surface, said engagement member capable of selectively detachably interconnecting said second body with said holster mount.

9. The holster securement system of claim 1 further comprising a vertical extension member attached to said holster mount.

10. The holster securement system of claim 1 further including a wedge member located between said holster and said body and connected to said holster mount, said wedge member having a surface angularly offset from an outer surface of said body.

11. A holster securement system for securing a holster to a belt, comprising:

(a) a body defining at one end at least one opening for receiving the belt;

(b) a fastening mechanism adapted to be rigidly connected to the holster and operatively engageable with said body, said fastening mechanism including a release member movable between a first position and a second position;

(c) said fastening mechanism selectively detachably interconnecting said body with the holster, said fastening mechanism rigidly connecting the holster to said body when said release member is in said first position, and said fastening mechanism enabling said body and said holster to be selectively movable with respect to each other when said release member is moved to said second position;

(d) a biasing mechanism urging said release member to said first position.

12. The holster securement system of claim 11 wherein said fastening mechanism selectively secures the holster to said body at one of a plurality of locations on said body while said body remains fixed relative to the belt.

13. The holster securement system of claim 12 wherein one of said locations on said body is vertically displaced from another of said locations on said body, so that said holster may be connected to said body at two different heights relative to said body.

14. The holster securement system of claim 12 wherein one of said locations on said body is angularly displaced from another of said locations on said body, so that said holster may be connected to said body at two different angular orientations relative to said body.

15. The holster securement system of claim 14 wherein the holster is movable vertically relative to said body when said release member is in said second position.

* * * * *

UNITED STATES PATENT AND TRADEMARK OFFICE

CERTIFICATE OF CORRECTION

PATENT NO. : 6,161,741
DATED : December 19, 2000
INVENTOR(S) : John M. French

It is certified that error appears in the above-identified patent and that said Letters Patent is hereby corrected as shown below:

Title page,
Item [63], should read
-- Related U.S. Application Data
Provisional application No. 60/139,147, filed on June 14, 1999 --.

Signed and Sealed this

Twenty-sixth Day of November, 2002

*Attest:*

*Attesting Officer*

JAMES E. ROGAN
*Director of the United States Patent and Trademark Office*